US005653354A

United States Patent [19]

Olson

[11] Patent Number: 5,653,354

[45] Date of Patent: Aug. 5, 1997

[54] STACKABLE CONTAINER SYSTEM FOR FLOWABLE MATERIALS

[75] Inventor: Gary L. Olson, Clarion, Iowa

[73] Assignee: Noslo Enterprises, Inc., Clarion, Iowa

[21] Appl. No.: 517,550

[22] Filed: Aug. 21, 1995

[51] Int. Cl.[6] ..... B65D 19/36; B65D 21/02; B65D 33/38; F16K 31/46

[52] U.S. Cl. ..... 220/9.1; 206/511; 206/595; 220/401; 220/403; 222/105; 222/181.2; 251/294

[58] Field of Search ..... 220/9.1, 401, 403, 220/404, 9.2; 206/595, 386, 511; 222/105, 181.2, 528, 529; 251/294; 137/512; 383/67

[56] References Cited

U.S. PATENT DOCUMENTS

| | | | |
|---|---|---|---|
| Re. 32,232 | 8/1986 | Bonerb et al. | 222/105 X |
| Re. 34,560 | 3/1994 | Schnaars | 383/67 X |
| 860,506 | 7/1907 | Williams | 220/9.2 X |
| 1,187,749 | 6/1916 | Lane . | |
| 2,666,552 | 1/1954 | Coit, Jr. . | |
| 2,675,947 | 4/1954 | Wynn, Sr. . | |
| 2,690,277 | 9/1954 | Shea et al. . | |
| 3,035,682 | 5/1962 | Ferch . | |
| 3,083,879 | 4/1963 | Coleman | 222/143 |
| 3,104,035 | 9/1963 | McKinney . | |
| 3,122,258 | 2/1964 | Shile . | |
| 3,135,432 | 6/1964 | McKinney . | |
| 3,255,927 | 6/1966 | Rupert, Jr. et al. | 222/143 |
| 3,265,254 | 8/1966 | Carter et al. . | |
| 3,270,921 | 9/1966 | Nadolske et al. . | |
| 3,318,473 | 5/1967 | Jones et al. . | |
| 3,372,725 | 3/1968 | Voorhees . | |
| 3,464,594 | 9/1969 | Forman . | |
| 3,602,400 | 8/1971 | Cook | 222/185 |
| 3,776,435 | 12/1973 | Smith | 222/566 |
| 3,785,534 | 1/1974 | Smith | 222/460 |
| 4,054,223 | 10/1977 | Marques | 220/4.28 |
| 4,071,452 | 1/1978 | Friese | 222/482 |
| 4,119,263 | 10/1978 | Cuthbertson et al. | 222/528 X |
| 4,247,021 | 1/1981 | Renier et al. | 222/143 |
| 4,480,766 | 11/1984 | Platt | 222/105 |
| 4,541,549 | 9/1985 | Hadley et al. | 222/143 |
| 4,646,357 | 2/1987 | Nattrass | 383/20 |
| 4,691,371 | 9/1987 | Derby | 383/67 X |
| 4,715,515 | 12/1987 | Steilen | 222/143 |
| 4,759,473 | 7/1988 | Derby et al. | 222/529 X |
| 4,811,419 | 3/1989 | Derby | 383/67 |
| 4,817,824 | 4/1989 | LaFleur et al. | 222/105 |
| 4,836,421 | 6/1989 | Miyoshi et al. | 222/166 |
| 4,917,266 | 4/1990 | Kellenberger et al. | 222/105 |
| 4,949,872 | 8/1990 | Heaps, Jr. | 222/105 |
| 4,966,310 | 10/1990 | Hawkins | 222/105 |

(List continued on next page.)

FOREIGN PATENT DOCUMENTS

| | | | |
|---|---|---|---|
| 0338573 | 10/1989 | European Pat. Off. | 206/386 |
| 0562748 | 9/1993 | European Pat. Off. | 383/67 |
| 2639037 | 5/1990 | France | 220/9.1 |
| 1293750 | 10/1972 | United Kingdom | 220/401 |

OTHER PUBLICATIONS

Sudenga Industries, Inc., 2002 Kingbird Ave., George, IA 51237 "Bulk Seed Caddy", 2 papes, Sep. 1994.

*Primary Examiner*—Gary E. Elkins
*Assistant Examiner*—Niki M. Kopsidas
*Attorney, Agent, or Firm*—Rothwell, Figg, Ernst & Kurz, P.C.

[57] ABSTRACT

A container system for flowable materials includes a frame having a bottom, front, rear, and at least one side. The frame includes a support tray disposed above the bottom and having a discharge chute. A pair of spaced apart tubes for receiving the forks of a forklift extend horizontally from the front to the rear of the frame below the support tray. The container system further includes a bag having a bottom portion adapted to rest on the support tray and having a discharge opening registered with the discharge chute. The bag has a flap that normally covers the discharge opening. A slide mechanism mounts at the side of the frame, transversely to the tubes, and is connected to the flap so as to peel it back to uncover the discharge opening and thereby dispense flowable material.

13 Claims, 6 Drawing Sheets

U.S. PATENT DOCUMENTS

| | | | |
|---|---|---|---|
| 4,966,311 | 10/1990 | Taylor | 222/105 |
| 4,998,991 | 3/1991 | Poulton | 222/181.3 |
| 5,018,877 | 5/1991 | Kantz | 383/67 |
| 5,033,706 | 7/1991 | Poulton | 222/105 X |
| 5,161,693 | 11/1992 | Friman | 206/597 |
| 5,199,612 | 4/1993 | Raque | 222/134 |
| 5,257,725 | 11/1993 | Volk, Jr. et al. | 222/185.1 |
| 5,257,893 | 11/1993 | Sevits | 222/105 X |
| 5,320,251 | 6/1994 | Ellis | 222/105 |
| 5,322,195 | 6/1994 | Ellis | 222/105 |
| 5,333,757 | 8/1994 | Volk et al. | 222/105 X |
| 5,340,218 | 8/1994 | Cuthbertson | 220/402 X |
| 5,341,959 | 8/1994 | Ellis | 222/105 |
| 5,437,384 | 8/1995 | Farrell | 220/401 X |
| 5,445,289 | 8/1995 | Owen | 222/105 |

STACKABLE CONTAINER SYSTEM FOR FLOWABLE MATERIALS

BACKGROUND OF THE INVENTION

The present invention relates to the field of containers for storing and handling flowable materials. In particular, this invention relates to a stackable container system for grains, fertilizers, pesticides, herbicides and the like.

Moving, storing and dispensing flowable materials have been persistent problems in the agricultural industry. Many of the flowable materials used in agriculture, such as herbicides, pesticides and fertilizers, are harmful to the environment. Some materials are skin irritants or are otherwise harmful to humans, particularly the workers handling them. Therefore, the container system must securely hold the materials and dispense them without injuring workers or the environment.

Some known container systems utilize gravity discharge by having a chute located near the bottom of the container and far inboard from its sides. The operator is required to reach under the container to open the discharge chute. As the chute is opened, the discharging material can potentially come into contact with the hand of the operator. Even if gloves are worn, the force of the discharging material can also injure the operator.

Existing container systems are often raised and transported by fork lifts or similar equipment. The mechanism for opening the discharge chute resides on the same side of the container that the forklift approaches from. Therefore, the forklift effectively blocks access to the discharge mechanism unless a space is left between the side of the container and the mast of the forklift. The space allows the necessary access, but places the operator in an awkward, confining and potentially dangerous position. Serious injury and even death can result if the container, its contents, or the forklift shift position suddenly.

Some existing container systems comprise a bag having a pair of sleeves disposed across from one another at the top opening of the bag. These sleeves receive the forks of a forklift which can hoist the bag. Unfortunately, stacking height is limited with such bags because the forks of the forklift must be raised to the top of the bag to engage the sleeves when stacking. Limited stacking height contributes to poor utilization of warehouse space.

Therefore a primary objective of the present invention is the provision of a container system that is more efficient to use than existing container systems.

A further objective of the present invention is the provision of a container system which is safer to use, particularly one that is safely dischargeable without putting the operator in a perilous position.

A further objective of the present invention is the provision of a container system that is quicker and easier to dump than existing container systems, as well as quicker and easier to fill.

A further objective of the present invention is the provision of a container system which is stackable and efficiently utilizes storage space.

A further objective of the present invention is the provision of a container system which utilizes a detachable and replaceable receptacle or bag.

A further objective of the present invention is the provision of a container system wherein the receptacle has a flexible discharge chute cover flap that peels back to open the chute.

A further objective of the present invention is the provision of a container system that is economical to manufacture and durable in use.

These and other objectives will be apparent from the description and claims which follow.

SUMMARY OF THE INVENTION

The present invention is a container system for flowable materials which includes a frame having a bottom, front, rear, and at least one side. A support tray disposed above the bottom of the frame. The support tray includes a discharge chute. A pair of spaced apart tubes for receiving the forks of a forklift extend horizontally from the front to the rear of the frame below the support tray.

The container system further includes a bag having a bottom portion adapted to rest on the support tray. A discharge opening in the bottom of the bag registers with the discharge chute on the frame. The bag has a peelable flap that normally covers the discharge opening.

A slide mechanism mounts at the side of the frame, transversely to the tubes, and is connected to the flap so as to peel it back to uncover the discharge opening and thereby dispense the flowable materials.

DETAILED DESCRIPTION OF THE PREFERRED EMBODIMENT

Figure 1:
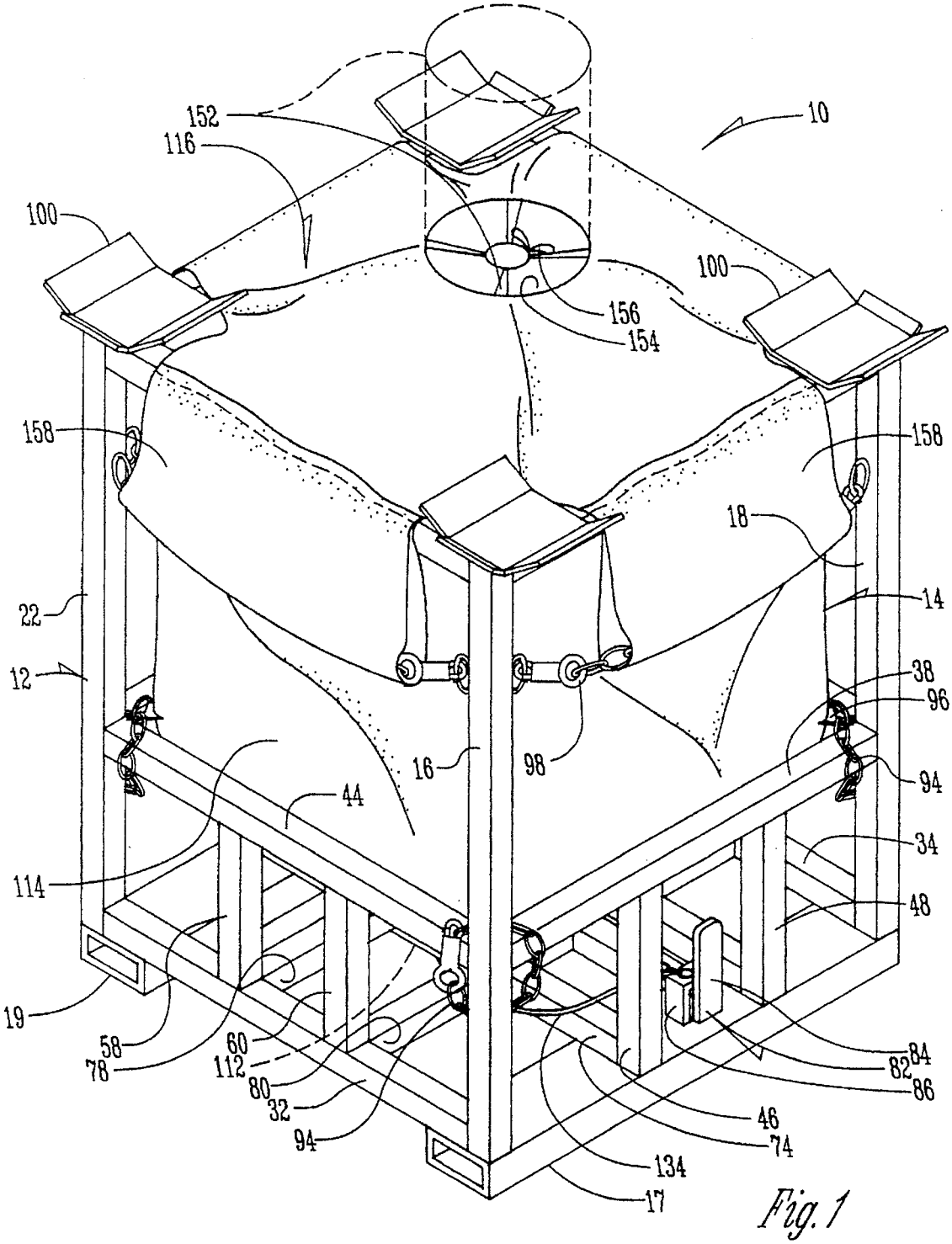
FIG. 1 is a perspective view of the container system of the present invention.

In the figures and the following description, the container system of the present invention is designated by reference numeral 10. Referring to FIG. 1, the container system 10 includes a stackable frame 12 and a receptacle 14 for holding flowable materials, such as grains, herbicides, pesticides and the like. These materials may be granular, liquid, or grain form. Preferably the receptacle 14 is detachably mounted on the frame 12 so that the receptacle 14 is removable for replacement or cleaning if necessary.

Figure 2:
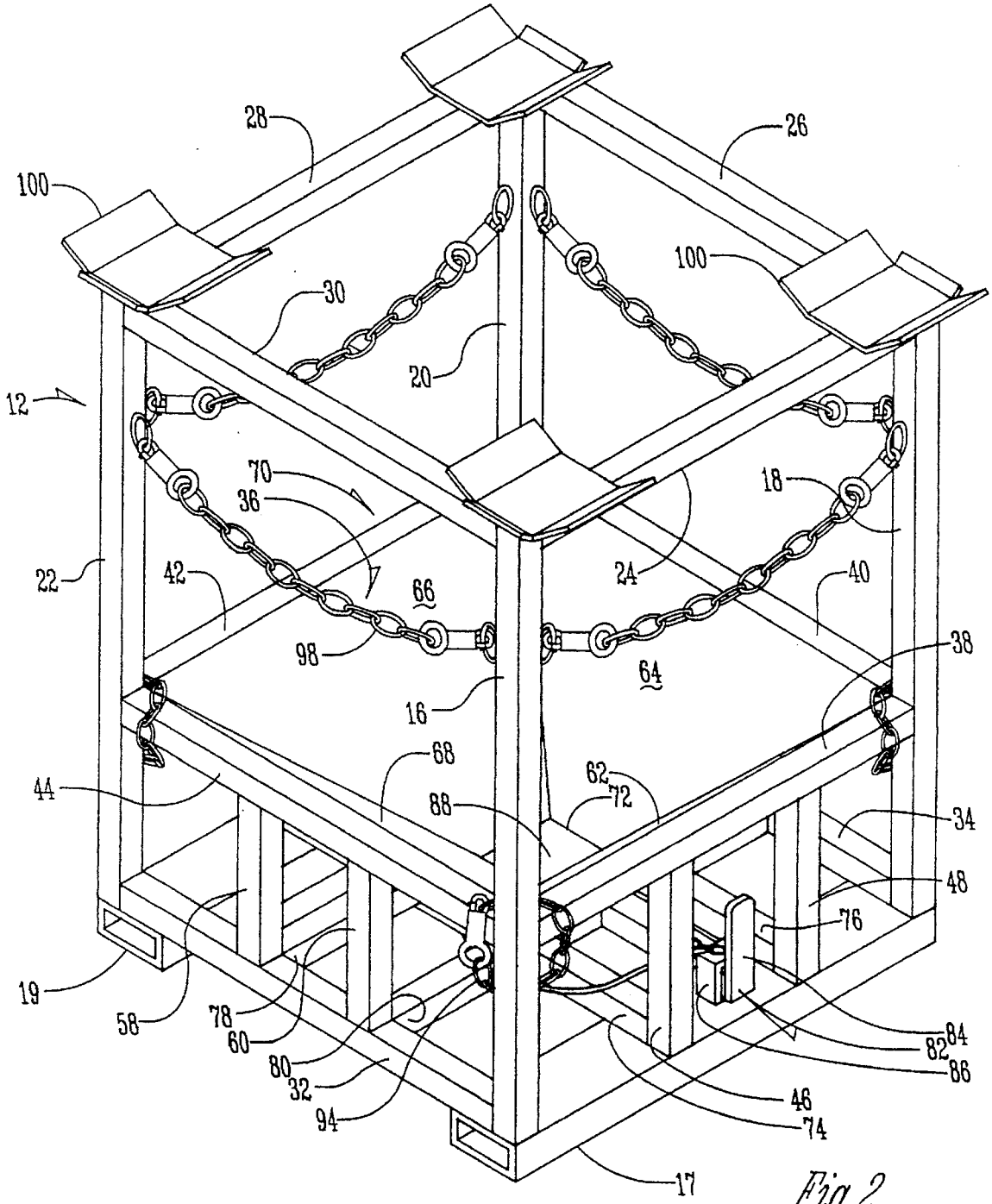
FIG. 2 is a perspective view of the frame and securing means of the container system shown in FIG. 1.

FIG. 2 shows the frame 12 with the receptacle 14 removed. The frame 12 has a plurality of uprights 16,18, 20,22 preferably interconnected by substantially horizontal cross members 24,26, 28,30,32,34 at the top and bottom. The rectilinear shape of the frame 12 allows the container systems 10 to be tightly packed next to each other in order to best utilize the available storage space. Other less space conserving shapes, such as cylindrical, are also contemplated. Even pyramidal or triangular shapes will not detract from the invention.

A pair of spaced apart and generally horizontal channel members or tubes 17,19 extend longitudinally from the front to the rear of the frame 12 adjacent its bottom. The elongated tubes 17,19 are attached by conventional means at each end to one of the uprights 16,18,20,22 and/or to one of the cross members 32,34. Preferably the tubes 17,19 are parallel to each other and perpendicular to the front of the frame 12 so as to receive the spaced apart and parallel lifting members (forks) of a conventional forklift (not shown).

Preferably the insides of tubes 17,19 measure three inches in height by seven inches in width to accommodate the standard forks of a forklift. Furthermore, the horizontal distance between the tubes 17,19 is approximately twenty-eight inches. This particular spread between the tubes 17,19 makes the frame 12 versatile enough to be lifted by a conventional twenty-seven inch wide slip plate inserted between the tubes. The legs of most conventional hydraulic handjacks can also be inserted into the space between the tubes 17,19 on the frame 12, thereby allowing the handjack to transport the container system 10. Thus, the container system 10 is versatile and can be lifted by various conventional moving equipment or lifting means. Other arrangements and dimensions are also suitable so long as they mate with the lifting means to be used.

A rigid tray 36 supports the receptacle 14. The tray 36 is mounted by conventional means, such as welding or screw-like fasteners, between the uprights 16,18,20,22 above cross members 32,34 on beams 38,40,42,44. Preferably beams 38,40,42,44 are each reinforced by a respective pair of columns 46,48. The tray 36 has walls 62,64,66,68 which are angled downwardly at a 45 degree angle from a horizontal plane and converge inwardly toward one another so as form a discharge chute 70 shaped like an inverted frustum of a pyramid. The shape of the discharge chute provides for the quick departure of the flowable material from the frame because the discharge chute 70 terminates in and defines a discharge opening 72 in tray 36.

To improve the rigidity of the frame 12 and further support the discharge chute 70, auxiliary cross members 74,76,78,80 are connected to the cross members 32,34, the tubes 17,19, and the columns 46,48. The auxiliary cross members 74,76 extend transversely and overlap auxiliary cross members 78,80 which extend longitudinally along the bottom of the frame 12. The adjacent auxiliary cross members are spaced apart to provide room for the discharge functions which will be described later.

Figure 6:
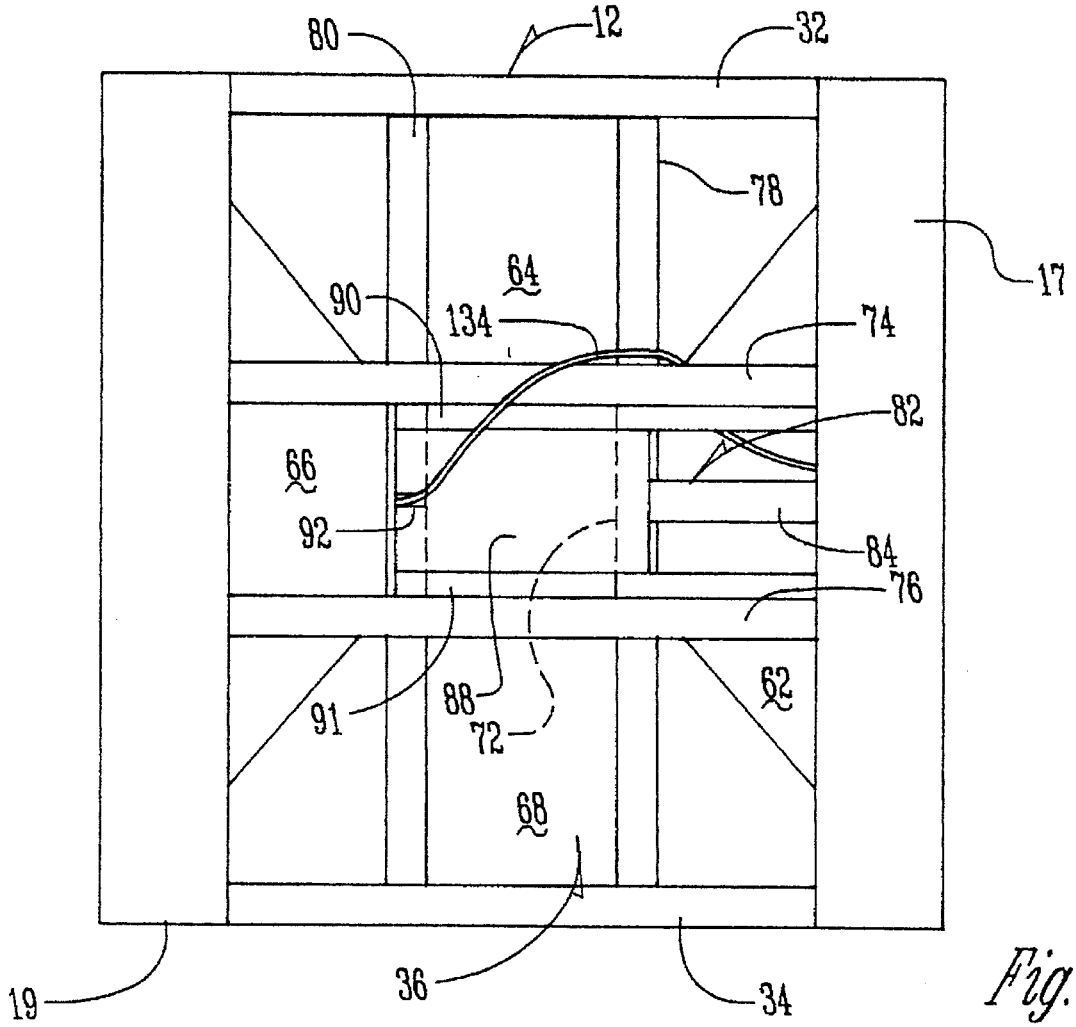
FIG. 6 is a bottom view of the container system shown in FIG. 1.

A slide mechanism 82 mounts on one of the tubes 17,19. The slide mechanism 82 includes a L-shaped lever 84 which has a leg that slides horizontally through a slide bracket 86. As best seen in FIG. 6, the lever 84 is connected to a rigid cover plate 88. Cover plate 88 slidably mounts between a pair of parallel guide rails 90,91 attached to the auxiliary cross members 74,76 respectively and spaced below the discharge opening 72. The cover plate 88 slides over the top of the guide rails 90 and normally resides directly under the discharge opening 72 at the apex of the chute 70.

Pulling the lever 84 causes the cover plate 88 to be retracted from underneath the discharge opening 72 and moved laterally toward the side of the frame 12. Thus, the position and movement of the slide mechanism 82, including the lever 84 and the cover plate 88, is angled, and in fact, is substantially transverse to the channel members or tubes 17,19. The operator can access the lever 84 without venturing between the forklift and the frame 12. Furthermore, when a first person operates the slide mechanism 82 and a second person operates the forklift, the first person is more readily seen by the second person because neither the forklift nor the container system 10 block the view of the second person. Greater coordination among the operators is possible, reducing the risks of accidents.

As best seen in FIG. 6, the innermost end of the cover plate 88 has a notch 92 therein. Preferably the notch 92 is centrally located between the sides of the cover plate 88. The purpose of the notch 92 will be discussed below in conjunction with the description of the receptacle 14 and the completed container system 10.

Referring again to FIG. 2, various means are included on the frame 12 for securing the receptacle 14 to it. At the top of the tray 36, individual chains or cables 94 loop around each of the four corners of the tray 36 just inside one or more of the uprights 16,18,20,22. As seen in FIG. 1, one end of the cable 94 is attached to the upright 16,18,20,22 or the tray 36. The other end of cable 94 is threaded through a corresponding loop or ring 96 attached to the lower corners of the central portion of the bag 14. Then the latter end is detachably attached to the upright 16,18,20,22 or the tray 36 so as to secure the lower part of the bag 14 to the frame 12.

Referring again to FIG. 2, above the tray 36 yet below the top of the frame 12, chain or cable means 98 attach to one or more of the uprights 16,18,20,22. Preferably one end of the cable means 98 is detachably attached to the upright 16,18,20,22. As will be discussed below these means cooperate with various structures on the receptacle 14 to secure it to the frame 12.

Figure 3:
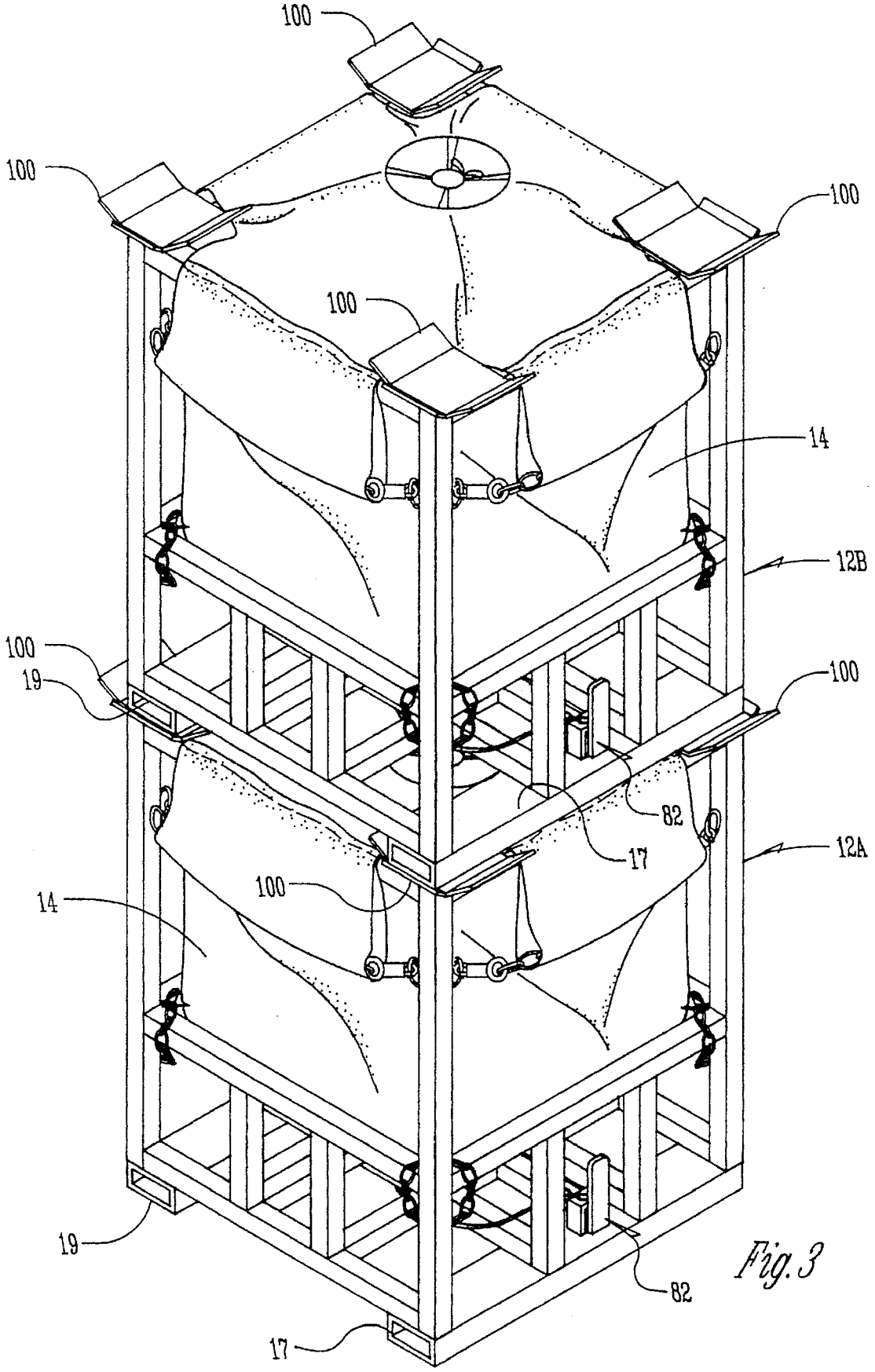
FIG. 3 is a perspective view of the container system of this invention which illustrates its stackability.
Figure 4:
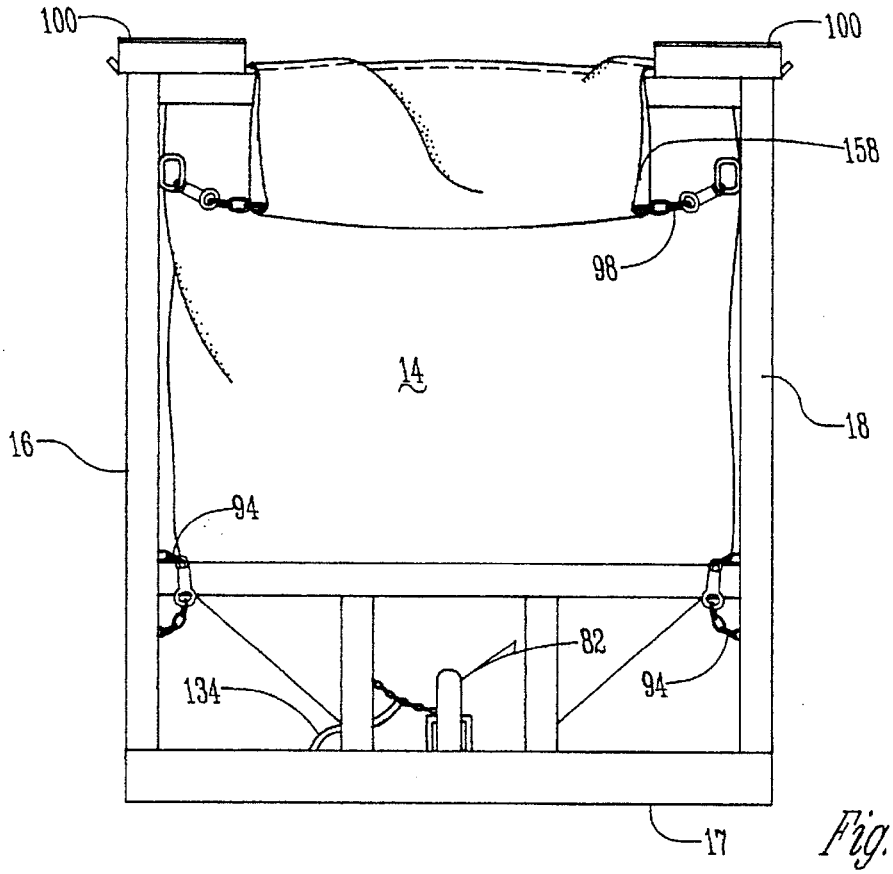
FIG. 4 is a side elevation view of the container system shown in FIG. 1.
Figure 5:
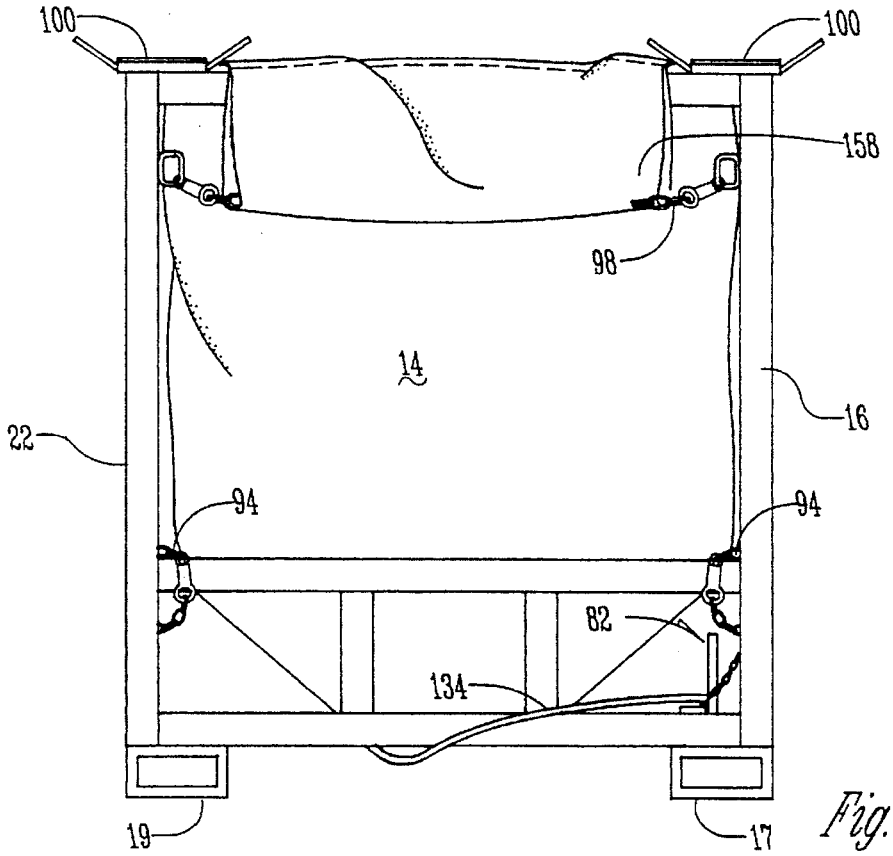
FIG. 5 is a front elevation view of the container system shown in FIG. 1.

The corners at the top of the frame 12 each have a flange 100 mounted to one or more of the intersecting cross members 24,26,28,30 or uprights 16,18,20,22. These flanges 100 serve as channel members for receiving the ends of tubes 17,19 so as to allow the vertical stacking of a second frame 12B on top of a first frame 12A as illustrated in FIG. 3. The flanges 100 have opposite side portions that flare outwardly and upwardly at a 45 degree angle. from the horizontal central portion. The flared side portions help guide the tube 17,19 into the flange 100 and help restrict the lateral movement of the stacked frame 12B. The flange 100 also includes an outward end portion that is flared outwardly and upwardly at a 45 degree angle from the horizontal central portion. However, the outward end portion is shorter in height than the side portions so that the end openings of the tubes 17,19 are unobstructed for the purpose of inserting the forks of the forklift. The outward end portions help restrict the forward and rearward movement of the stacked frame 12B.

Figure 7:
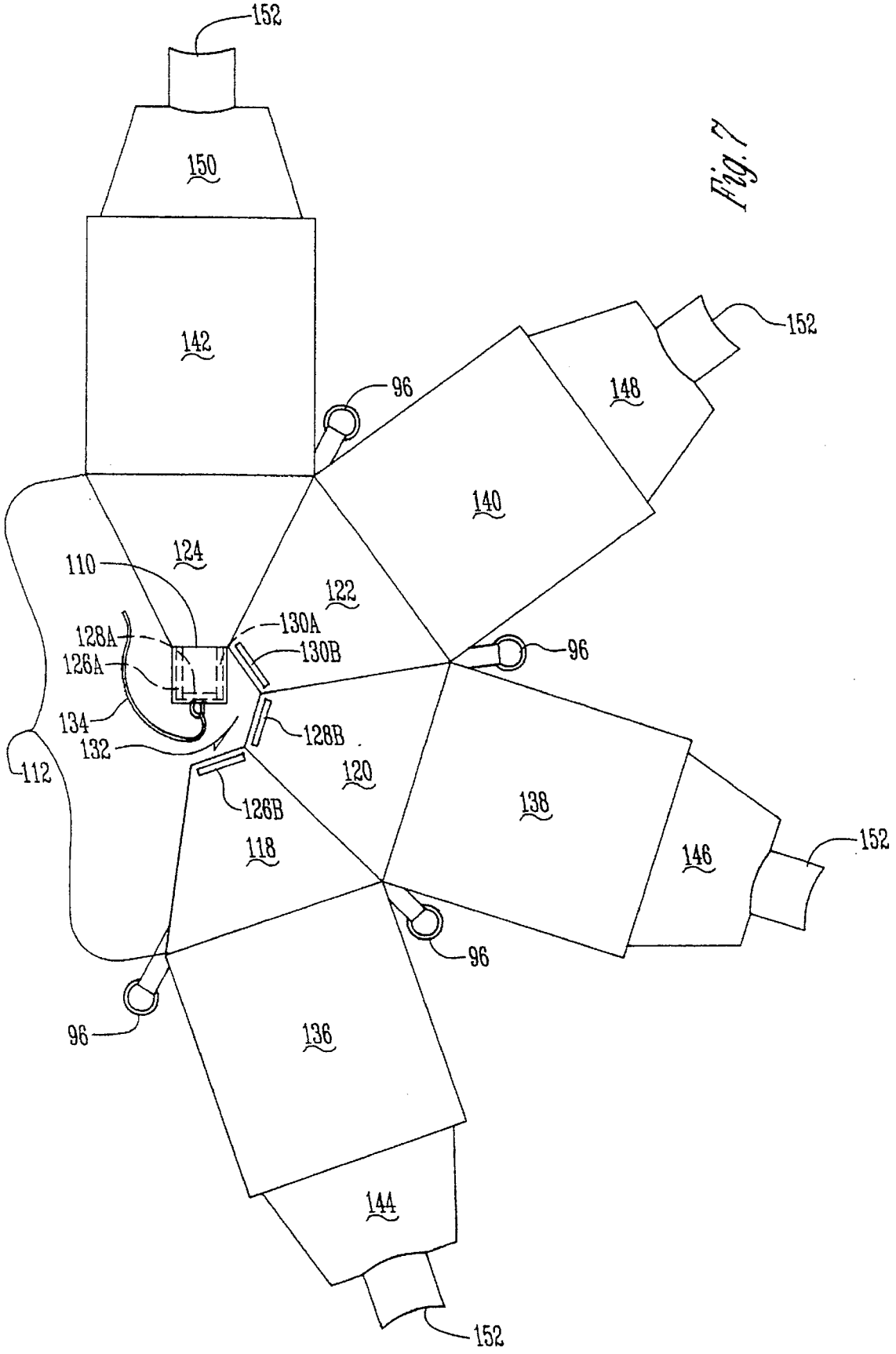
FIG. 7 is a plan view of the flowable material receptacle of the container system shown in FIG. 1. The receptacle has been dissected and separated at its seams to provide a two-dimensional view. The retaining sleeves and loops have been also been omitted.

The receptacle or bag 14 is best seen in FIGS. 1 and 7. Plastic or another suitable material that is impervious to moisture preferably coats the interior surfaces of the flexible bag 14 to provide additional strength and prevent leakage. With the exception of the cover flap 110 which must be flexible, the receptacle 14 could also be formed or constructed of a rigid material such as aluminum, stainless steel, or plastic. The receptacle material should be lightweight and capable of containing the flowable material.

The bag 14 comprises a bottom portion 112, a central portion 114 and a top portion 116. The bottom portion 112 rests on the support tray 36 of the frame 12. Therefore, the bottom portion 112 of the bag 14 is formed into the shape of a frustum of a pyramid. As FIG. 7 shows, the bottom portion 112 includes four panels 118,120,122,124 which join together along seams or bends to form the pyramidal shape. When assembled or formed, the panels 118,120,122,124 slope downwardly and inwardly at a 45 degree angle with respect to horizontal. This matches the configuration of the tray 36 and allows the bag 14 to discharge the flowable material quickly.

One end of the cover flap 110 attaches to the lower end of panel 124, preferably fixing said end thereon. The opposite end and the adjacent sides of the cover flap 110 are free and each has a hooks and loops fastener strip 126A,128A,130A attached adjacent and parallel to their edge. The lower edge of each of the panels 118,120,122,124 includes a complementary hooks and loops fastener strip 126B,128B,130B attached thereon. Strips 126B,128B,130B register with and engage fastener strips 126A,128A,130A respectively when the cover flap 110 is drawn up into contact with the lower edges of the panels 118,120,122,124. Thus, the hooks and loops fastener strips retractably secure the cover flap 110 over a discharge opening 132 in the bottom portion 112 of the bag 14.

A pull cord or rope 134 attached to the free end of the cover flap 110 allows the flap to be pulled or peeled away from the opening 132 so the flowable materials can be discharged from the bag 14. The coordinated movement of the flap 110, cord 134, cover plate 88, and the slide mechanism 82 will be discussed below.

The central portion 114 of the bag 14 includes four side panels 136,138,140,142 whose bottom edges are attached to the respective upper edges of the lower portion panels 118,120,122,124. The side panels 136,138,140,142 join together with one another at bends or seams to form a square or rectangular shaped enclosure for the flowable material. The side panels 136,138,140,142 are substantially vertical in their assembled condition so as to facilitate the filling, storing and discharge of the flowable material. The central portion 114 holds the majority of the volume of the flowable material when the container 10 is full.

The top portion 116 of the bag 14 includes four top panels 144,146,148,150 which are respectively attached to the upper edges of the central portion side panels 136,138,140, 142. The sides of the top panels 144,146,148,150 taper inwardly from the bottom to the top so that they are pie shaped. Top panels 144,146,148,150 form a frustum of a pyramid when their sides are joined together. The top panels 144,146,148,150 preferably form a 30 degree angle with respect to horizontal to ensure smooth filling.

As seen in FIG. 1, the upper edges of the top panels 144,146,148,150 merge to form a cylindrical shaped upwardly extendible fill spout 152 at the center of the top portion 116. The fill spout 152 is flexible so that it can be folded or tucked away into the top portion 116 of the bag 14 when not in use (see FIG. 1). The fill spout 152 is retained in its tucked position by a plurality of wedge shaped cover sleeves 154. The sleeves 154 each have a base attached to one of the top panels 144,146,148,150 and an apex with a fold therein for receiving a common drawstring 156 which tightens the sleeves 154 over the fill spout 152.

The bag 14 also includes sleeves 158 for securing the bag to the frame 12. Each retaining sleeve 158 has opposite ends which are attached to the bag 14 adjacent the top edge of its respective side panel 144,146,148, or 150. The retaining sleeve 158 has a central portion which forms a loop between the attached ends. The loop receives the cable means or chain 98 so as to help prevent the bag 14 from collapsing or moving excessively relative to the frame 12 during filling and discharging.

The assembly of the container system of the present invention begins with the spreading an empty receptacle or bag 14 between the uprights 16,18,20,22 of the frame 12. Then, the cables 94 are attached to the respective loops 96 at the lower corners of the central portion 114 of the bag 14. Next, the user further secures the bag 14 to the frame 12 by extending the cable means 98 through the respective retaining sleeves 158.

Referring again to FIG. 6, the user then pulls the lever mechanism 82, thereby sliding the cover plate 88 from underneath the discharge opening 72 in the frame 12. This allows the pull cord or rope 134 attached to the cover flap 110 to be threaded through the discharge chute 70 and opening 72. Then the rope 134 is threaded through the notch 92 in the cover plate 88 and around auxiliary cross member 74 or 76 before being attached to the lever 84 at the side of the frame 12.

Thus, the retraction of the cover plate 88 from opening 72 on the frame 12 is coordinated with the peeling back of the cover flap 110 on the bag 14. The notch 92 also allows the cover plate 88 to urge the cover flap 110 closed when the slide mechanism 82 is pushed toward the center of the frame 12. It is contemplated that the slide mechanism can be spring loaded so the cover plate 88 is normally urged closed over the discharge opening 72 when the lever 84 is released.

Now that the bag 14 has been mounted on the frame 12 and the chutes coordinated, a forklift operator can insert the forks into the tubes 17,19 (see FIG. 1) to transport the empty container 10 to a filling station having a conventional means (not shown) for dispensing flowable material. The drawstring 156 is loosened and the fill spout 152 is extended upwardly into the position indicated by dotted lines so as to receive flowable material. As the flowable material falls into the bag 14 through the fill spout 152, the retaining means 94,96,98,158 prevent the flexible bag 14 from collapsing inwardly.

When the bag 14 reaches the desired level of fullness, the operator shuts off the flow of material into the bag 14 and tucks the fill spout 152 back into the top portion of the bag 14. The wedge shaped sleeves 154 are then gathered over the retracted fill spout 152. The drawstring 156 is tightened to effectively prevent the escape of flowable material from the top portion of the container 10.

Containers, including frames 12A and 12B, filled with flowable material nest or stack on top of one another as shown in FIG. 3.

To dispense some or all of the contents of a container 10, the desired container is retrieved from its particular stack with a forklift. The forklift hoists and transports the container 10 to the desired location. Then, the forklift operator and/or an assisting operator, preferably positioned at the side of the container 10, directs the container so the discharge chute 70 is directly over the spot where the flowable material is to be dispensed.

It will be appreciated by those skilled in the art that the operator does not have to reach under the container 10 to discharge the material. The forklift operator attempting to position the container 10 can also see the assisting operator and therefore receive helpful instructions. Neither operator is required to venture between the forklift and the container or behind the container.

Whereas the invention has been shown and described in connection with the preferred embodiment thereof, it will be understood that modifications, substitutions, and additions may be made which are within the intended broad scope of the following claims. For example, the shape of the receptacle has been shown to be rectangular, but a cylindrical receptacle can also be used in a correspondingly shaped frame. The bottom of the receptacle and the support tray on which it rests could be conical as well. Similarly, a threesided frustum of a pyramid at the bottom of the receptacle and support tray would not detract from the invention.

From the foregoing, it can be seen that the present invention accomplishes at least all of the stated objectives.

What is claimed is:

1. A container system for flowable materials, the container system comprising:

a frame having a bottom, front, rear, and at least one side; the frame including a support tray having a discharge chute therein, the support tray being disposed above the bottom, and a pair of spaced apart elongated channel members extending in a substantially horizontal plane from the front of the frame to the rear of the frame below the support tray and being capable of receiving lifting members of a lifting means;

a receptacle for flowable materials, the receptacle having a bottom portion resting on the support tray of the frame, the bottom portion of the receptacle having a discharge opening therein registered with the discharge chute and further having a cover flap with a movable portion selectively positionable in covering relation with the discharge opening;

means for retracting the cover flap from the discharge opening so as to allow flowable materials to exit the receptacle and depart from the frame, the means for retracting the cover flap being located at one of the sides of the frame and thereby extending generally transversely with respect to the channel members.

2. The container system of claim 1 wherein the means for retracting the cover flap comprises an elongated cable having opposite ends, one of the ends being connected to the cover flap and the other of the ends being connected to a lever mounted on the frame.

3. The container system of claim 2 wherein the lever is slidably mounted to the frame at one of the sides of the frame.

4. The container system of claim 2 wherein the cable includes a rope.

5. The container system of claim 1 wherein the cover flap has an anchor portion fixed to the receptacle and the movable portion is detachably secured to the receptacle by a hooks and loops fastener.

6. The container system of claim 5 wherein the means for retracting the cover flap includes a pull cord attached to the cover flap and a lever mounted on one of the channel members at one of the sides of the frame whereby the cover flap can be peeled back from the discharge opening by pulling the lever and thereby the pull cord.

7. The container system of claim 1 further comprising a rigid cover plate connected to the means for retracting and slidably attached to the frame in selectively covering relation with the discharge chute so as to provide support for the cover flap.

8. The container system of claim 1 wherein the channel members are disposed at the bottom of the frame.

9. The container system of claim 1 further comprising means for securing the receptacle to the frame, the means for securing including a cable connected to the receptacle and the frame.

10. The container system of claim 9 wherein the receptacle has a top portion and the means for securing the receptacle to the frame includes a sleeve formed on the top portion of the receptacle for receiving the cable, the cable having opposite ends both attached to the frame and a central portion extending through the sleeve.

11. The container system of claim 1 wherein the top of the frame includes a plurality of stacking flanges capable of receiving the channel guides of a second frame when the second frame is set on top of the first frame.

12. The container system of claim 1 wherein the cover flap is constructed of a flexible fabric.

13. The container system of claim 1 wherein the receptacle is constructed of a material that is substantially impervious to moisture.

* * * * *